US009435339B2

(12) United States Patent
Calhoun et al.

(10) Patent No.: US 9,435,339 B2
(45) Date of Patent: Sep. 6, 2016

(54) VIBRATION/NOISE MANAGEMENT IN A SCROLL COMPRESSOR

(71) Applicant: AGILENT TECHNOLOGIES, INC., Loveland, CO (US)

(72) Inventors: John Calhoun, Lexington, MA (US); Ronald J. Forni, Lexington, MA (US); George Galica, Worcester, MA (US); Vannie (Yucong) Lu, Billerica, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 539 days.

(21) Appl. No.: 13/800,028

(22) Filed: Mar. 13, 2013

(65) Prior Publication Data

US 2014/0271242 A1 Sep. 18, 2014

(51) Int. Cl.

| | |
|---|---|
| ***F04B 35/04*** | (2006.01) |
| ***F04C 15/00*** | (2006.01) |
| ***F04C 29/06*** | (2006.01) |
| ***F04C 18/02*** | (2006.01) |

(52) U.S. Cl.

CPC ..... *F04C 15/0057* (2013.01); *F04C 18/0215* (2013.01); *F04C 29/066* (2013.01); *F04C 2270/12* (2013.01)

(58) Field of Classification Search

CPC .. F04C 18/0215; F04C 29/06; F04C 29/063; F04C 29/065; F04C 29/066; F04C 29/068; F04C 2270/12; F04C 2270/125; F04C 15/0057; F04B 39/0044

USPC ..... 417/361, 363; 248/638, 673

See application file for complete search history.

(56) References Cited

U.S. PATENT DOCUMENTS

| | | | | |
|---|---|---|---|---|
| 4,676,473 | A | 6/1987 | Giles | |
| 5,158,514 | A | 10/1992 | Braga | |
| 5,467,111 | A | 11/1995 | Furukawa et al. | |
| 6,103,995 | A * | 8/2000 | Bankstahl | B23K 9/10 219/133 |
| 7,398,855 | B2 | 7/2008 | Seel | |
| 7,465,156 | B2 * | 12/2008 | Lee | F04B 39/0044 417/363 |
| 7,583,043 | B2 | 9/2009 | Chung et al. | |

(Continued)

FOREIGN PATENT DOCUMENTS

| | | |
|---|---|---|
| EP | 1621769 | 2/2006 |
| EP | 2505777 | 10/2012 |

(Continued)

OTHER PUBLICATIONS

Search Report mailed Sep. 30, 2014 in UK Application No. GB1402147.1.

*Primary Examiner* — Charles Freay

(57) ABSTRACT

A scroll pump isolates vibrations of a pump head/motor assembly of the pump from the exterior of the pump and thus, suppresses the production of airborne noise. The pump includes a sound-muffling enclosure surrounding the pump head/motor assembly, feet supporting the enclosure, and elastic vibration isolators. The pump head/motor assembly is fixed to the tops of the vibration isolators, and the sound-muffling enclosure is fixed to the vibration isolators at the bottoms of the isolators. The scroll pump also has a locking system by which motion of the pump head/motor assembly relative to the sound-muffling enclosure can be limited or prevented, and by which the sound-muffling enclosure can be hard-mounted to a support surface independently of the feet.

13 Claims, 6 Drawing Sheets

1

(56) References Cited

U.S. PATENT DOCUMENTS

| | | | | |
|---|---|---|---|---|
| 7,753,996 | B1 | 7/2010 | Deane et al. | |
| 8,177,534 | B2 | 5/2012 | Ni | |
| 2005/0106037 | A1 | 5/2005 | Kim et al. | |
| 2005/0166921 | A1 | 8/2005 | DeVries et al. | |
| 2012/0167888 | A1* | 7/2012 | Taylor | A61M 16/10 128/205.12 |
| 2013/0017100 | A1* | 1/2013 | Ota | F01C 21/10 417/321 |

FOREIGN PATENT DOCUMENTS

| | | |
|---|---|---|
| JP | 2003247495 | 9/2003 |
| WO | WO2009105627 | 8/2009 |

* cited by examiner

VIBRATION/NOISE MANAGEMENT IN A SCROLL COMPRESSOR

BACKGROUND

1. Field of the Invention

The present invention relates to a scroll pump having a pump head/motor assembly that includes a stationary plate scroll having a stationary scroll blade, an orbiting plate scroll having a scroll blade nested with the stationary scroll blade, and a pump motor having a rotary output coupled to the orbiting plate scroll so as to drive the orbiting scroll blade relative to the stationary scroll blade. In particular, the present invention relates to a scroll pump having a system that reduces the noise and vibration produced by the pump head/motor assembly.

2. Description of the Related Art

A scroll pump is a type of pump that includes a stationary plate scroll having a stationary plate and a spiral stationary scroll blade projecting axially therefrom, and an orbiting plate scroll having an orbiting plate and a spiral orbiting scroll blade projecting axially therefrom. The stationary and orbiting scroll blades are nested with a clearance and predetermined relative angular positioning such that a pocket (or pockets) is delimited by and between the stationary and orbiting scroll blades. The stationary plate scroll is fixed in the pump. The orbiting scroll plate and hence, the orbiting scroll blade, is coupled to an eccentric driving mechanism. The stationary and orbiting plate scrolls and the eccentric drive mechanism may make up what is referred to as a pump head.

The eccentric drive mechanism is, in turn, connected to and driven by a motor of the pump such that the orbiting scroll plate orbits about a longitudinal axis of the pump passing through an axially central portion of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is collapsed. Thus, the fluid in the pocket is compressed and thereby discharged through the outlet of the pump.

In the case of a vacuum-type of scroll pump, the inlet of the pump is connected to a chamber that is to be evacuated. Conversely, in the case of a compressor-type of scroll pump, the outlet of the pump is connected to a chamber that is to be supplied with pressurized fluid by the pump.

In any case, the rotary components of the pump head and motor produce vibrations. These vibrations, in turn, can generate sound waves, i.e., the rotary components can create a significant amount of noise. The vibrations can also be transmitted to other nearby equipment, resulting in reduced performance of that equipment.

SUMMARY

It is a general object of the present invention to provide a scroll pump in which vibrations of a pump head/motor assembly of the pump are isolated from the exterior of the pump including the supportive base which the pump is resting on.

It is a more specific object of the present invention to provide a scroll pump that runs quietly.

It is another object of the present invention to provide a scroll pump which has a pump head/motor assembly supported by a vibration isolation system and yet which can be transported without the pump head/motor assembly being allowed to move relative to other components of the pump and potentially damage the components.

It is likewise another object of the present invention to provide a method by which a scroll pump, having a pump head/motor assembly supported by a vibration isolation system, can be transported without being damaged.

It is still another object of the present invention to provide a scroll pump having a system that can isolate vibrations of the pump head/motor assembly, and in which the movement of the pump head/motor assembly is restricted independently of the vibration isolation system so that adverse shocks will not damage components of the pump during operation.

According to one aspect of the invention, there is provided a scroll pump having a pump head/motor assembly, a sound-muffling enclosure in which the pump head/motor assembly is housed, feet that support the sound-muffling enclosure and which have bottom surfaces constituting the bottom of the pump, and a vibration isolation system comprising a set of elastic vibration isolators each having top and bottom ends, and in which the pump head/motor assembly is fixed to the vibration isolators at the top ends thereof so as to be integrated with the vibration isolators, the sound-muffling enclosure is fixed to the vibration isolators at the bottom ends thereof, and the pump head/motor assembly is attached in the pump to the sound-muffling enclosure via the vibration isolators. Therefore, the pump head/motor assembly is movable under the elasticity of the vibration isolators relative to the sound-muffling enclosure. Accordingly, the vibration isolation system isolates the sound-muffling enclosure from vibrations transmitted from the pump head/motor assembly.

According to another aspect of the invention, there is provided a scroll pump having a pump head/motor assembly, feet having bottom surfaces that constitute the bottom of the pump, a vibration isolation system to which the pump head/motor assembly is mounted, a sound-muffling enclosure interposed between the vibration isolation system and the feet such that the sound-muffling enclosure is also interposed between the pump head/motor assembly and the feet, and a selective locking system by which the motion of the pump head/motor assembly can be locked independently of the vibration isolation system to the sound-muffling enclosure, and by which the sound-muffling enclosure can be locked to the same support surface that the feet are resting on independently of the feet and without the pump head/assembly being locked to the sound-muffling enclosure such that the pump head/motor assembly is supported by the support surface only via the vibration isolation system.

Therefore, the pump can be placed in a first mode, in which the feet are resting against the support surface while the pump head/motor assembly is hard mounted to the sound-muffling enclosure such that it can not move relative to the sound-muffling enclosure.

The first mode may be a shipping mode. In the shipping mode the sound-muffling enclosure is also rigidly mounted to the support surface. If the pump is shipped as a self contained product, the support surface is typically a plywood base that forms the bottom of a shipping container. Alternatively the support surface may be a structural component of a larger piece of equipment when the pump is integrated and shipped, as an integrated component, with the larger piece of equipment.

In addition, the pump can be placed in a second mode in which the feet are resting against a support surface while the pump head/motor assembly is not locked to the sound-muffling enclosure and the sound-muffling enclosure is locked to the support surface independently of the feet. Accordingly, the sound-muffling enclosure can be hard mounted to the support surface such that it can not move relative to the support surface while the pump head/motor assembly is free mounted to the sound-muffling enclosure via the vibration isolation system such that the pump head/motor assembly can vibrate relative to the sound-muffling enclosure and support surface.

This second mode may be the operational configuration of the pump when it is an integrated component of a larger piece of machinery, i.e., the second mode may be what is referred to as an integrated component in operational mode. In this case, the support surface would typically be a structural surface within the larger piece of machinery. This mode allows the pump head/motor assembly to vibrate within the sound-muffling enclosure without transmitting vibrations to the equipment or noise to the operator of the equipment, while the pump is nonetheless securely fastened to the support surface in the equipment.

In addition, the pump can be placed in a third mode, i.e. bench top operational mode, in which the feet are resting against a support surface while the pump head/motor assembly is not locked to the sound-muffling enclosure. Accordingly, the sound-muffling enclosure is not hard mounted to the support surface and can be located and moved as required while the pump head/motor assembly is free mounted to the sound-muffling enclosure via the vibration isolation system such that the pump head/motor assembly can vibrate relative to the sound-muffling enclosure and supportive surface. This third mode would be the operational configuration of the pump when it is used as a stand-alone component not integrated as a component within a large piece of equipment. The supportive surface would typically be a table or bench top. This mode allows the pump head/motor assembly to vibrate within the sound-muffling enclosure without transmitting vibrations to the support surface or to the operator of the equipment, while allowing the pump to be easily portable. In this mode, the sound muffling enclosure would be supported via elastic feet by the support surface, i.e. table, further reducing transmitted vibrations.

According to still another aspect of the present invention, there is provided a vibration management method for a scroll pump having a pump head/motor assembly supported by a vibration isolation system within an enclosure. The method includes setting feet at the bottom of an enclosure of the pump atop a support surface such that a pump head/motor assembly of the pump housed within the enclosure is supported by the support surface only via the vibration isolation system, and either subsequently locking the pump head/motor assembly to the support surface independently of the vibration isolation system so that the pump can be transported along with the support surface in a state in which the pump head/motor assembly is prevented from moving relative to the support surface, or fastening the enclosure independently of the feet to the support surface while operating the pump in a state in which the pump head/motor assembly is supported by the support surface only via the vibration isolation system.

BRIEF DESCRIPTION OF THE DRAWINGS

These and other objects, features and advantages of the present invention will be better understood from the detailed description of the preferred embodiments thereof that follows with reference to the accompanying drawings, in which.

DETAILED DESCRIPTION

Figure 1A:
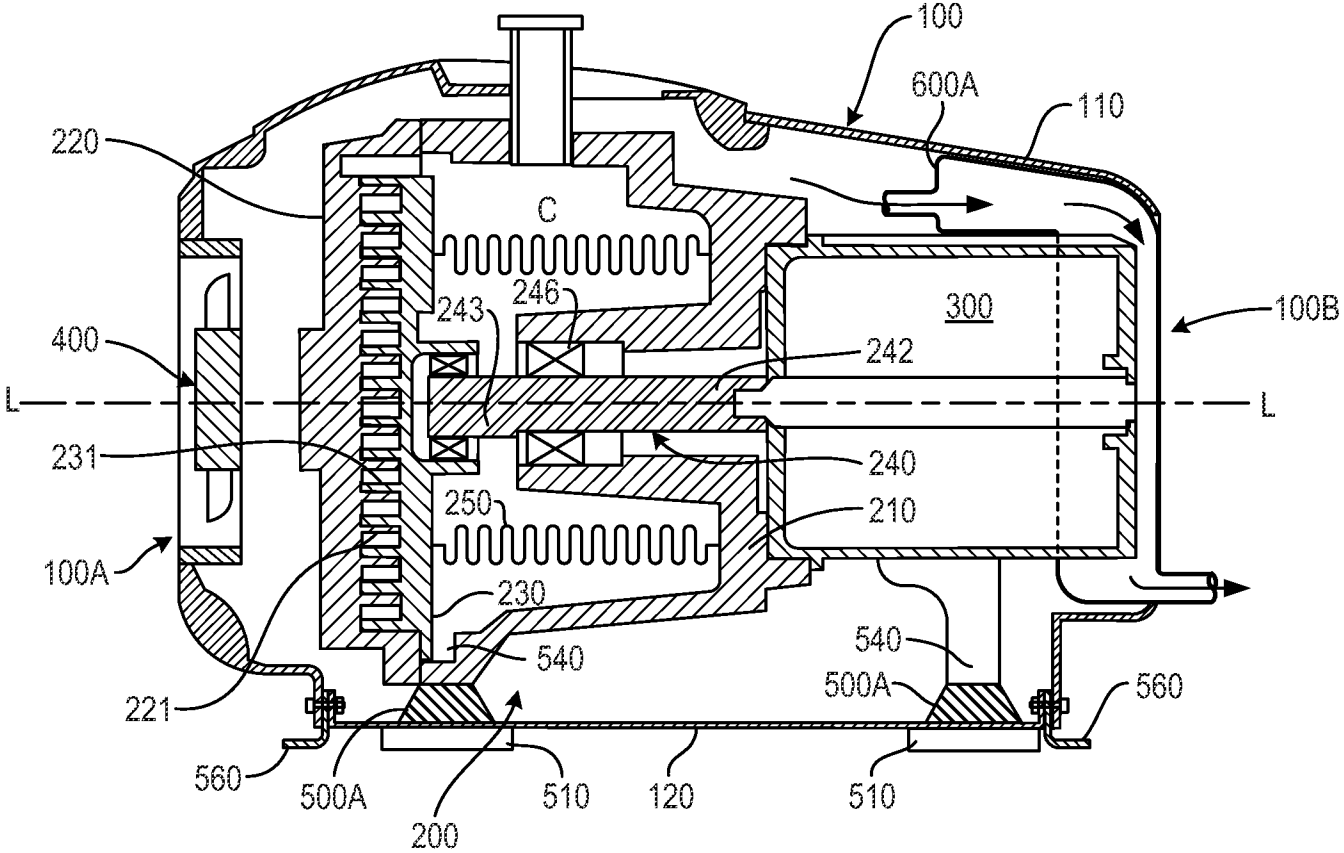
FIG. 1A is a schematic longitudinal sectional view of a scroll pump according to the present invention.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, terminology used herein for the purpose of describing particular examples or embodiments of the inventive concept is to be taken in context. For example, the terms "comprises" or "comprising" when used in this specification indicates the presence of stated features or processes but does not preclude the presence of additional features or processes. The term "pump" may refer to apparatus that drives, or raises or decreases the pressure of a fluid, etc. The term "fixed" may be used to describe a direct connection of two parts to one another in such a way that the parts can/do not move relative to one another or a connection of the parts through the intermediary of one or more additional parts in such a way that the parts can/do not move relative to each other.

Figure 1B:
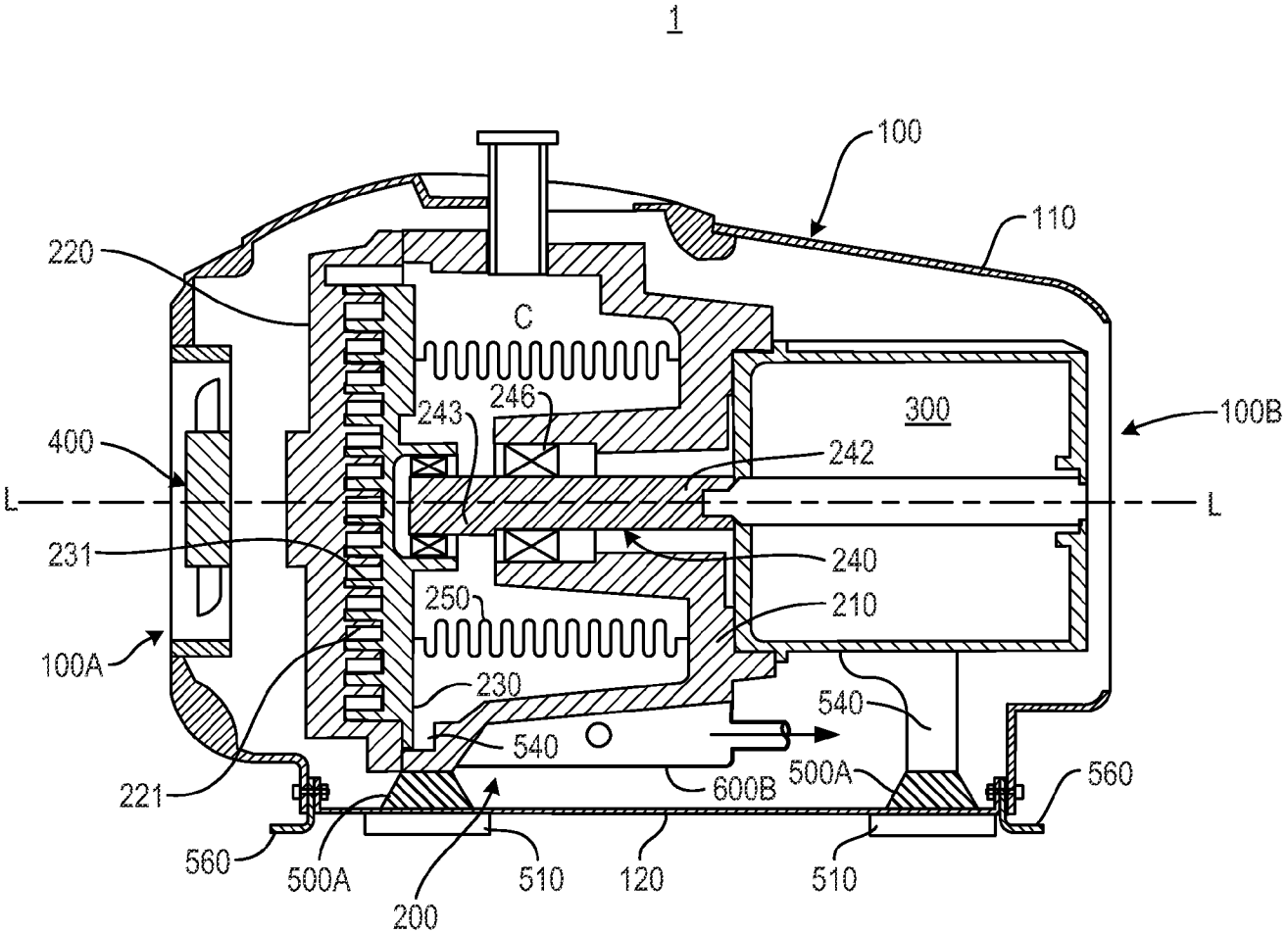
FIG. 1B is a schematic longitudinal sectional view of another version of a scroll pump according to the present invention.

Referring now to FIGS. 1A and 1B, a scroll pump 1 according to the present invention includes a sound muffling enclosure 100, a pump head 200, a pump motor 300, and a cooling fan 400 housed in the sound muffling enclosure 100. Specifically, the pump head 200, pump motor 300, and cooling fan 400 are juxtaposed with one another along a longitudinal axis of the scroll pump 1, i.e., in an axial direction of the scroll pump 1. Furthermore, the sound muffling enclosure 100 has opposite ends in the axial direction. The ends of the sound muffling enclosure 100 define an air inlet 100A and an air outlet 100B, respectively. The air outlet 100B may be defined by a grill.

The pump head 200 includes a frame 210, a stationary plate scroll 220, an orbiting plate scroll 230, an eccentric drive mechanism 240, an annular metallic bellows 250 and fasteners fixing the stationary plate scroll 220 to the frame 210 and the annular metallic bellows 250 to both the frame 210 and the orbiting plate scroll 230.

The stationary plate scroll 220 comprises a stationary scroll blade 221, and the orbiting plate scroll 230 comprises an orbiting scroll blade 231. The stationary scroll blade 221 and the orbiting scroll blade 231 are nested with a clearance and predetermined relative angular positioning such that a pocket or pockets is/are delimited by and between the stationary and orbiting scroll blades. In this respect, side surfaces of the stationary scroll blade 221 and the orbiting scroll blade 231 need not contact each other to seal the pocket(s). Rather, minute clearances between side surfaces of the stationary scroll blade 221 and the orbiting scroll blade 231 may create a seal sufficient for forming a satisfactory pocket(s).

The eccentric drive mechanism 240 includes a drive shaft and bearings 246. In this example, the drive shaft is a crank shaft having a main portion 242 coupled to the pump motor 300 so as to be rotated by the pump motor 300 about a longitudinal axis L of the scroll pump 1, and a crank 243 whose central longitudinal axis is offset in a radial direction from the longitudinal axis L. The bearings 246 comprise a plurality of sets of bearings having rolling elements.

Also, in this example, the main portion 242 of the crank shaft is supported by the frame 210 via one or more sets of the bearings 246 so as to be rotatable relative to the frame 210. The orbiting plate scroll 230 is mounted to the crank 243 via another set or sets of the bearings 246. Thus, the orbiting plate scroll 230 is carried by crank 243 so as to orbit about the longitudinal axis L of the scroll pump 1 when the main portion 242 is rotated by the pump motor 300, and the orbiting plate scroll 230 is supported by the crank 243 so as to be rotatable about the central longitudinal axis of the crank 243. The pump head 200 and the pump motor 300 connected to the main portion 242 of the eccentric drive mechanism 240 of the pump head 200 together constitute a pump head/motor assembly housed in the sound muffling enclosure 100.

Furthermore, the annular metallic bellows 250 has a first end at which the annular metallic bellows 250 is fixed to the back side of the orbiting plate scroll 230 and a second end at which the annular metallic bellows 250 is fixed to the frame 210. In this respect, the annular metallic bellows 250 is radially flexible enough to allow the first end thereof to follow along with the orbiting plate scroll 230 while the second end of the annular metallic bellows 250 remains fixed to the frame 210. On the other hand, the annular metallic bellows 250 has a torsional stiffness that prevents the first end of the annular metallic bellows 250 from rotating significantly about the central longitudinal axis of the annular metallic bellows 250, i.e. from rotating significantly hr its circumferential direction, while the second end of the annular metallic bellows 250 remains fixed to the frame 210.

The annular metallic bellows 250 may be essentially the only means of providing the angular synchronization of the stationary scroll blade 221 and the orbiting scroll blade 231 during the operation of the scroll pump 1. Moreover, not only does the annular metallic bellows 250 extend between the frame 210 and the orbiting plate scroll 230, but the annular metallic bellows 250 also extends around a portion of the crank 243 and the bearings 246 of the eccentric drive mechanism 240. In this way, the annular metallic bellows 250 may also seal the bearings 246 and bearing surfaces from a space defined between the annular metallic bellows 250 and the frame 210 in the radial direction and which space may constitute the working chamber, e.g., a vacuum chamber C of the scroll pump 1, through which fluid worked by the scroll pump 1 passes. Accordingly, lubricant employed by the bearings 246 and/or particulate matter generated by the bearing surfaces can be prevented from passing into the chamber C by the annular metallic bellows 250.

Figure 2:
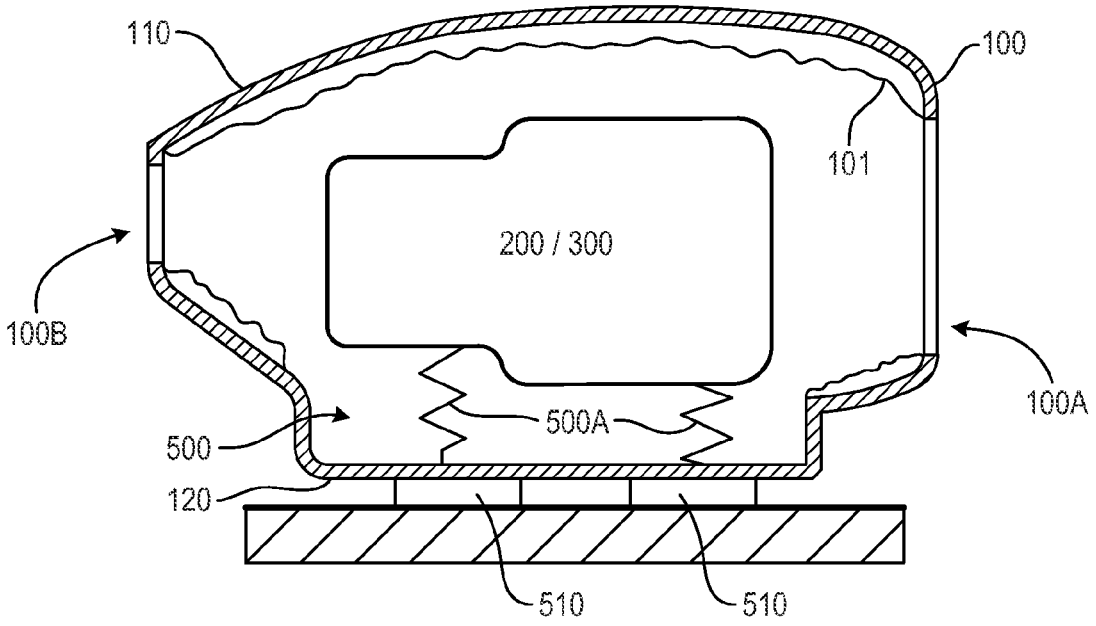
FIG. 2 is a schematic diagram of the scroll pump according to the present invention.

Referring to FIGS. 1A, 1B and 2, the pump head/motor assembly 200/300 is supported by a vibration isolation system 500 comprising a set of elastic vibration isolators 500A each having top and bottom ends. Specifically, the pump head/motor assembly 200/300 is fixed to the elastic vibration isolators 500A at the top ends thereof so as to be integrated with the elastic vibration isolators 500A. On the other hand, the sound muffling enclosure 100 is fixed to the elastic vibration isolators 500A at the bottom ends of the elastic vibration isolators 500A. The sound muffling enclosure 100 is disposed on and supported by feet 510 whose bottom surfaces constitute the bottom of the scroll pump 1. Each elastic vibration isolator 500A may pass through the sound muffling enclosure 100 and be unitary with a respective foot 510. The sound muffling enclosure 100 is seated on the feet 510 such that in this case as well, the sound muffling enclosure 100 is fixed via the feet 510 to the elastic vibration isolators 500A at the bottom ends of the elastic vibration isolators 500A where the elastic vibration isolators 500A join the feet 510.

Moreover, the feet 510 are configured so as to be essentially rigid, especially in comparison to the elastic vibration isolators 500A. Furthermore, the pump head/motor assembly 200/300 is attached in the scroll pump 1 to the sound muffling enclosure 100 only through the elastic vibration isolators 500A so as to be movable (due to the elasticity of the vibration isolators 500A) relative to the sound muffling enclosure 100. Therefore, the vibration isolation system 500 isolates the sound muffling enclosure 100 from vibrations transmitted from the pump head/motor assembly 200/300. Because the sound muffling enclosure 100 constitutes the exterior of the scroll pump 1, these vibrations are not imparted to the exterior of the scroll pump 1 or the support surface. Hence, the transmitted noise and vibration produced by the rotary components of the pump head/motor assembly 200/300 is substantially reduced.

To increase this effect, the sound muffling enclosure 100 may be formed in part or in whole of a known type of sound-absorbing material (101 in FIG. 2), or such sound-absorbing material 101 may be attached to the sound muffling enclosure 100.

A more detailed explanation of the sound-muffling effect provided by the present invention will be described with reference to FIG. 2.

The pump head/motor assembly 200/300, as a mass, is supported on the elastic vibration isolators 500A as springs. Thus, in this respect, the elastic vibration isolators 500A should be designed to damp the vibration of the mass. Specifically, the spring constant k of the elastic vibration isolators 500A should be such that the natural frequency measured in hertz of the mass supported by the springs ($\frac{1}{2}$ pi$\sqrt{k/m}$) is substantially less than lowest frequency of the vibrations that are expected to be produced by the apparatus. In the case of an apparatus such as a scroll pump, the components that produce vibrations of the lowest frequency are the rotary components, i.e., the lowest frequency of vibrations typically corresponds to the lowest frequency of rotation w of the rotary components, which in this case is the frequency of rotation of the pump motor 300. Thus, the vibration isolation system 500 is configured such that the natural frequency of the mass (pump head/motor assembly 200/300) mounted on the elastic vibration isolators 500A of spring constant k is less than the rotational frequency of the pump motor 300.

In this case, the elastic vibration isolators 500A will be effective in reducing the transmission of vibrations produced by the mass. However, although the lowest frequency of vibrations (e.g., ~10-60 Hz) produced by the rotary components during normal operation of the scroll pump 1 falls below or near the range of audible frequencies, the operation gives rise to harmonics within the range of audible frequencies. Therefore, the elastic vibration isolators 500A may do little to prevent airborne noise produced by the vibrating mass (pump head/motor assembly 200/300) at the rotation rate. However, they can substantially reduce the transmitted noise at the higher harmonics.

As is clear from the description above, the sound muffling enclosure 100 is a surround for the vibrating mass. Furthermore, the sound muffling enclosure 100 remains stationary or will at most vibrate to a much lower degree than the mass because the sound muffling enclosure 100 is attached to the elastic vibration isolators 500A at what amounts to the stationary end of the springs constituted by the elastic vibration isolators 500A. Thus, the sound muffling enclosure 100 will not vibrate to produce any airborne sound itself, and will block or cause the sound waves produced by the mass (pump head/motor assembly 200/300) to attenuate, thereby muffling the sound produced by the mass.

In this embodiment, the sound muffling enclosure 100 comprises a cowling 110 and a tray 120. The tray 120 has a top and a bottom, and the elastic vibration isolators 500A are mounted to the tray 120 at the top thereof. The pump head/motor assembly 200/300 is supported by the tray 120 atop the elastic vibration isolators 500A, and the cowling 110 is detachably connected to the tray 120 at locations spaced from the elastic vibration isolators 500A. The cowling 110 may be made up of several parts to facilitate its ability to be secured to and removed from the tray 120.

A scroll pump according to the present invention not only includes the above-described means for suppressing noise that would otherwise be produced by the vibrating of components of the scroll pump 1, but may also include means for suppressing noise otherwise produced by the flow of the fluid worked by the pump and discharged through the outlet 100B.

Specifically, the scroll pump 1 may also include an internal muffler. In the version of the scroll pump 1 shown in FIG. 1A, a muffler 600A is integrated with the cowling 110 and has an inlet that communicates (through piping) with the outlet of the set of the stationary plate scroll 220 and orbiting plate scroll 230 so as to receive the fluid worked between the stationary scroll blade 221 and the orbiting scroll blade 231 of the plate scrolls 220 and 230. Thus, as shown by the arrows, fluid is forced to exit the scroll pump 1 through the muffler 600A such that the noise otherwise produced by the discharged fluid is muffled. In the version shown in FIG. 1B, a muffler 600B is integrated with the frame 210. In this case, as well, the muffler 600B has an inlet that communicates (through piping) with the outlet of the set of the stationary plate scroll 220 and orbiting plate scroll 230 so as to receive the fluid worked between the stationary scroll blade 221 and the orbiting blade scroll 231 of the plate scrolls 220 and 230. Thus, the noise produced by the fluid is muffled before the fluid is discharged.

Next, a locking system for use in managing the vibrations and/or facilitating the transport of the scroll pump 1 in a safe way will now be described in detail.

Referring first to FIGS. 1A, 1B, and 3A-3C, the locking system comprises locking fasteners 540 (one of which is shown FIGS. 3A and 3B) for locking the pump head/motor assembly 200/300 to the sound muffling enclosure 100 independently of the vibration isolation system 500, and a set of locking brackets 560 (FIG. 1 and FIG. 3C) carried by the sound muffling enclosure 100 and through which fasteners can be inserted to lock the locking brackets 560 to a support surface. In examples of this embodiment, two locking brackets 560 may be provided at opposite axial ends of the scroll pump 1, and three or four locking fasteners 540 can be provided each at a respective side or axial end of the scroll pump 1. Example locations for the locking fasteners 540 at the opposite sides of the pump head/motor assembly 200/300 are indicated in FIGS. 1A and 1B.

Each locking fastener 540 includes a screw threaded to the pump head/motor assembly 200/300, and a motion arresting bracket 120B (referred to hereinafter as a "motion arrester") integral with the sound muffling enclosure 100. More specifically, the screw has a head 546 having a polygonal opening therein, e.g., a square or hexagonal recess, a shaft 542 comprising a screw thread, and a stopper 544 molded to the shaft 542 adjacent the head 546 so as to be integral with the shaft 542. The head 546 and stopper 544 may, as shown in the drawings, be unitary, formed of plastic and molded to the shaft 542 such that the shaft 542 extends from the head 546/stopper 544.

In addition, the pump head/motor assembly 200/300 has threaded openings 200/300T therein which receive the shafts 542 of the screws, respectively, such that the screws are threadingly engaged with and hence, carried by the pump head/motor assembly 200/300. Both the sound muffling enclosure 100 and the motion arrester 120B have openings therethrough axially aligned with a threaded opening 200/300T in the pump head/motor assembly 200/300, i.e., with the head 546 of the screw carried by the pump head/motor assembly 200/300.

Therefore, the screw can be rotated with a tool 525 (FIG. 3A), inserted into the opening in the head 546 of the screw, to cause the screw to translate relative to the sound muffling enclosure 100. Thus, the stopper 544 can be moved toward or away from the motion arrester 120B as the screw is rotated. In particular, when the screw is turned with the tool 525 clockwise (i.e., is tightened with respect to that part of the sound-muffling enclosure 100 defining the threaded opening that receives the screw), the stopper 544 is moved away from the motion arrester 120B. Conversely, when the screw is turned counterclockwise, the stopper 544 is moved toward the motion arrester 120B. Accordingly, the screw may be considered to be a set screw.

In addition, in this embodiment, the motion arrester 120B has a recess in a side thereof facing the stopper 544. The recess in the stopper 544 and a side of the motion arrester 120B facing the recess have complementary shapes. In this example, at least part of the recess and part of the stopper 544 have complementary frusto-conical shapes.

Figure 3A:
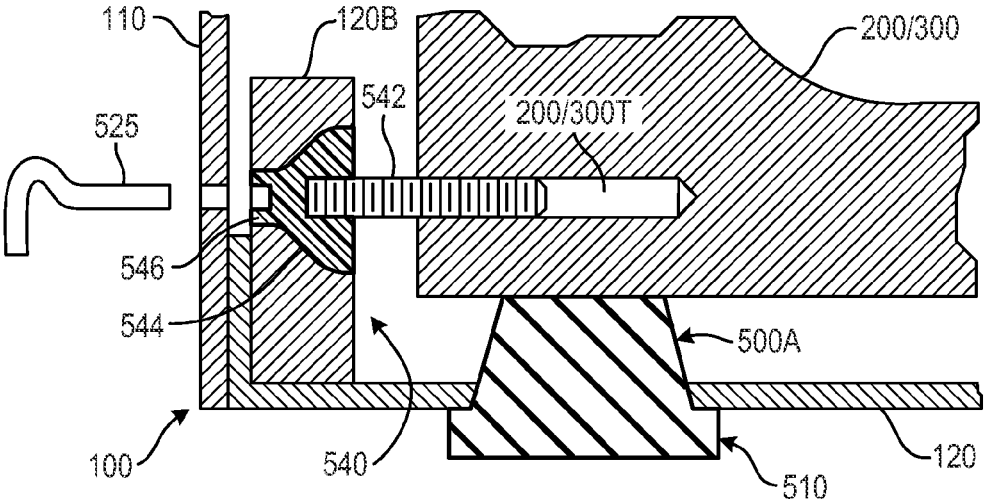
FIG. 3A is an enlarged longitudinal sectional view of part of the scroll pump according to the present invention, illustrating a locking fastener of the pump.
Figure 3B:
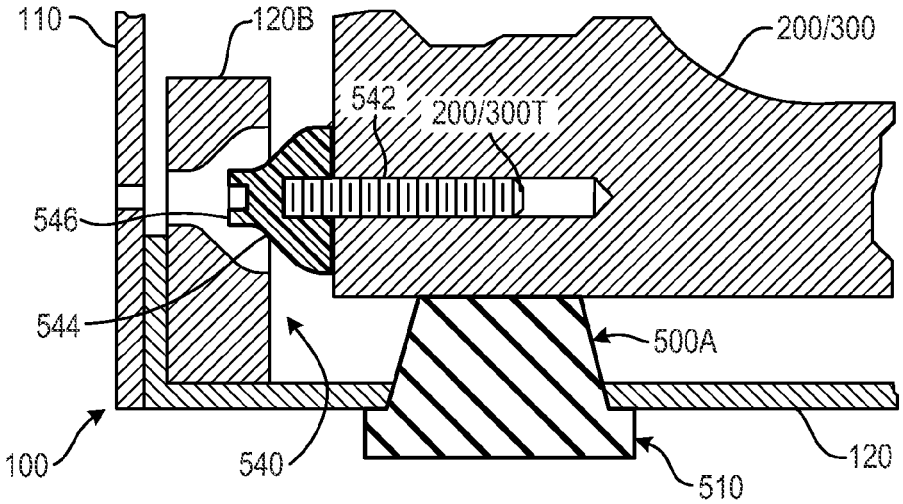
FIG. 3B is a view similar to that of FIG. 3A but showing the locking fastener in another position.
Figure 3C:
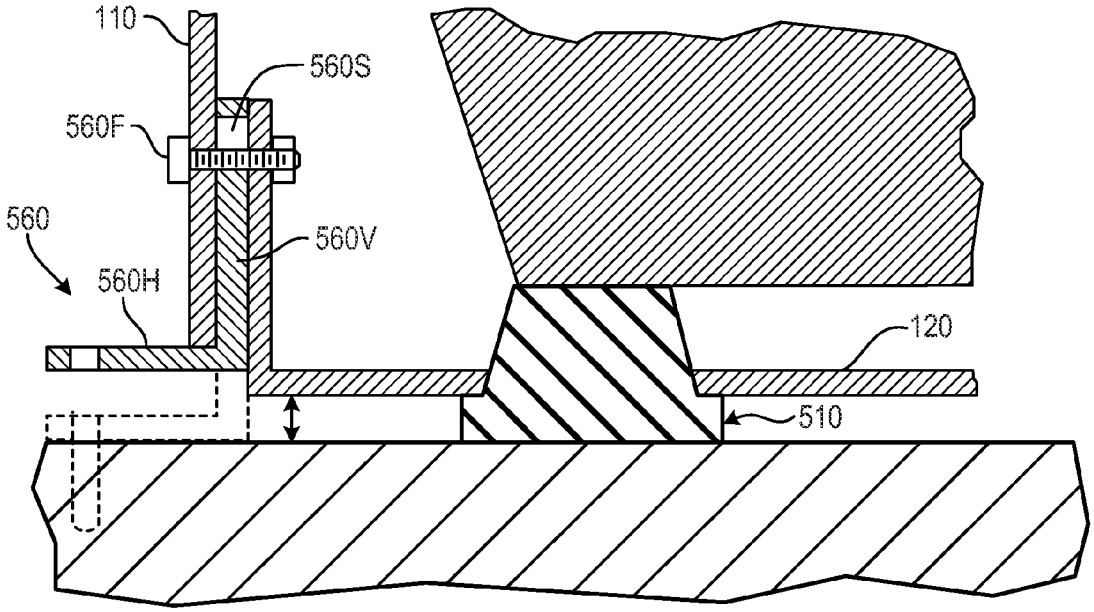
FIG. 3C is an enlarged longitudinal sectional view of another part of the scroll pump according to the present invention, illustrating a locking bracket of the pump.

Referring to FIG. 3C, each of the locking brackets 560 includes a horizontal leg 560H having an opening extending vertically therethrough and through which a fastener can be inserted to fasten the locking bracket 560 to a support surface, and a vertical leg 560V having a slot 560S elongated in the vertical direction extending therethrough. A (threaded) fastener 560F extends freely through the slot 500S in the vertical leg 560V and clamps the locking bracket 560 to the sound muffling enclosure 100 as sandwiched between the cowling 110 and tray 120. The fastener 560F can be loosened and retightened to allow the locking bracket 560 to be raised and lowered (as shown by the double-headed arrows) relative to the sound-muffling enclosure 100 between, and selectively fixed in, a first position (solid line position) at which the bottom of the locking bracket 560 is located above the level of the bottom surfaces of the feet 510 in the scroll pump 1 and a second position (phantom lines) at which the bottom of the locking bracket 560 is disposed level with the bottom surfaces of the feet 510.

Figure 4:
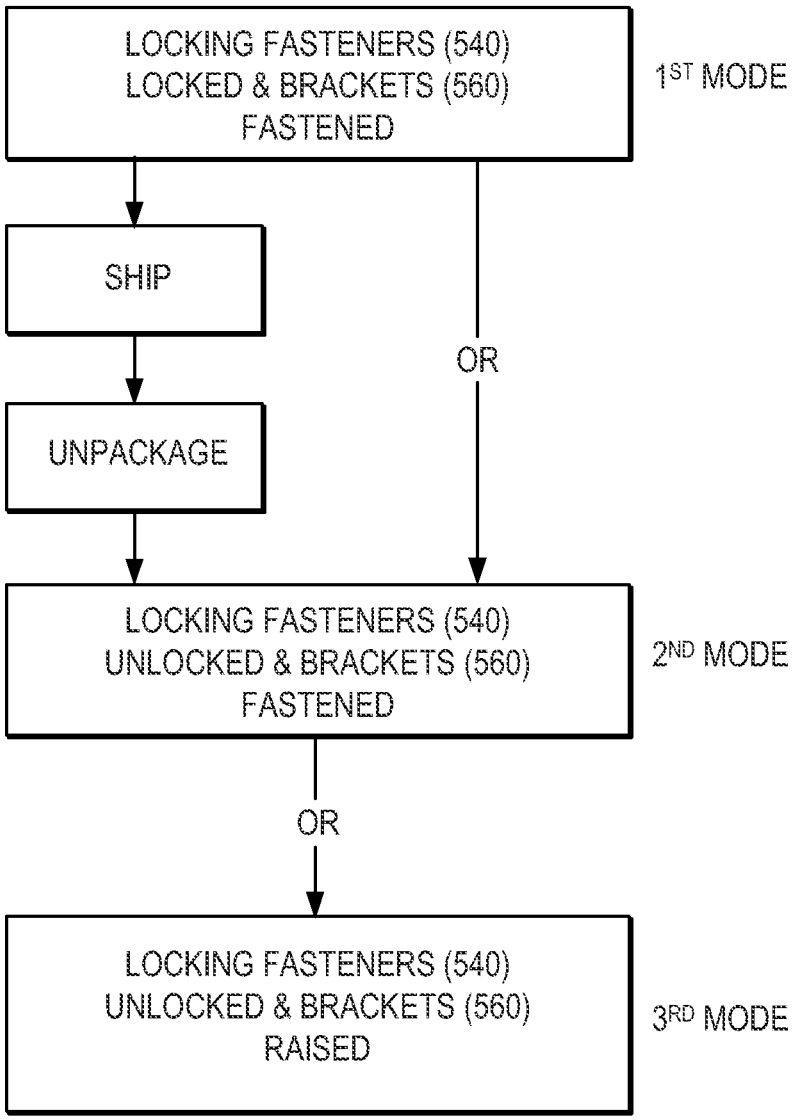
FIG. 4 is a diagram illustrating the various modes or set-ups that a scroll pump having a locking system according to the present invention can assume in managing vibrations of the pump head/motor assembly of the pump.

The operation and use of the locking system of the scroll pump 1 according to the present invention will now be described with reference to FIGS. 2-4.

Basically, the pump head/motor assembly 200/300 can be locked independently of the vibration isolation system 500 to the sound muffling enclosure 100. In addition, the sound muffling enclosure 100 can be locked to the same support surface that the feet 510 are resting on independently of the feet 510 and without the pump head/assembly 200/300 being locked to the sound muffling enclosure 100 such that the pump head/motor assembly 200/300 is supported by the support surface only via the elastic vibration isolators 500A of the vibration isolation system 500.

Accordingly, the scroll pump 1 can be placed using the locking system in a first mode in which the feet 510 are set against the support surface, the locking brackets 560 are set in the lowered position (phantom line position) shown in FIG. 3C, and the locking fasteners 540 are set to the position shown in FIG. 3A in which the stoppers 544 are mated to the motion arresters 120B, respectively. Therefore, the pump head/motor assembly 200/300 is hard mounted to the sound muffling enclosure 100 such that it cannot move relative to the sound muffling enclosure 100.

Furthermore, the locking brackets 560 may be fastened to the support surface in the first mode. The support surface may be a packing base, such as a sheet of plywood. In this case, the first mode is a shipping mode in which the scroll pump 1 can be transported, along with the packing base, in such a state that there is virtually no relative movement between the packing base, the sound muffling enclosure 100 and the pump head/motor assembly 200/300 despite the presence of the vibration isolation system 500 between the pump head/motor assembly 200/300 and the sound-muffling enclosure 100. Alternatively the support surface may be a structural component of a larger piece of equipment when the scroll pump 1 is integrated and shipped, as an integrated component, with the larger piece of equipment.

In either case, the pump head/motor assembly 200/300 will not contact and damage other components of the scroll pump 1 which are mounted to the sound-muffling enclosure 100, such as the cooling fan 400 and/or a circuit board.

The scroll pump 1 can also be placed using the locking system in a second mode in which the feet 510 are set against a support surface, the locking brackets 560 are set in the lowered position (phantom line position) shown in FIG. 3C, and the locking fasteners 540 are set in the position shown in FIG. 3B in which the stoppers 544 are disengaged from the motion arresters 120B, respectively and abut the pump head/motor assembly 200/300.

Furthermore, the locking brackets 560 are fastened to the support surface in the second mode. The support surface may be a working surface on which the scroll pump 1 is to be operated. The working surface may be the base of some larger machine. In this case, the second mode is a mode in which the scroll pump 1 can be operated while the sound muffling enclosure 100 is hard mounted to the support surface (i.e., cannot move relative to the support surface) and the pump head/motor assembly 200/300 is free mounted to the sound muffling enclosure 100 via the vibration isolation system 500 (i.e., such that the pump head/motor assembly 200/300 can vibrate relative to the sound muffling enclosure 100).

Still further, the scroll pump 1 can be operated in a third mode in which the feet 510 are set against a support surface, the locking brackets 560 are set in the raised position (solid line position) shown in FIG. 3C, and the locking fasteners 540 are set in the position shown in FIG. 3B in which the stoppers 544 are disengaged from the motion arresters 120B, respectively. This is the mode (bench top mode) basically shown in and described with reference to FIG. 2.

Note, to place the scroll pump 1 in either of the second and third modes, the set screws may be turned (clockwise) until the stoppers 544 are disengaged from the motion arresters 120B, respectively, and abut the pump head/motor assembly 200/300. Despite the fact that the stoppers 544 are disengaged from the motion arresters 120B, the locking system may limit the range over which the pump head/motor assembly 200/300 can move (vibrate) relative to the sound muffling enclosure 100 due to the fact that portions of the screws remain within the recesses of the motion arresters 120B. In this respect, the radial clearance between the screw and motion arrester 120B is set to allow for the pump head/motor assembly 200/300 to vibrate up to its maximum amplitude (e.g., 0.5 mm) during normal operation of the scroll pump 1. Thus, the locking fasteners 540 may also constitute motion limiters that prevent the pump head/motor assembly 200/300 from vibrating abnormally relative to the sound-muffling enclosure 100, which could otherwise result in damage to the scroll pump 1.

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A scroll pump comprising:

a pump head/motor assembly including a stationary plate scroll fixed in the pump, an orbiting plate scroll, a pump motor having a rotary output, and a drive shaft coupling the pump motor to the orbiting plate scroll;

feet having bottom surfaces that constitute the bottom of the pump, whereby the bottom surfaces of the feet will rest against a support surface when the pump is set on the support surface in its operating position;

a vibration isolation system to which the pump head/motor assembly is mounted;

a sound-muffling enclosure interposed between the vibration isolation system and the feet such that the sound-muffling enclosure is also interposed between the pump head/motor assembly and the feet; and a locking system by which the pump head/motor assembly can be locked independently of the vibration isolation system to the sound-muffling enclosure, and by which the sound-muffling enclosure can be locked to the same support surface that the feet are resting on independently of the feet and without the pump head/motor assembly being locked to the sound-muffling enclosure such that the pump head/motor assembly is supported by the support surface only via the vibration isolation system, wherein the pump can be selectively placed using the locking system in a first mode in which the feet are resting against the support surface while the pump head/motor assembly is hard mounted to the sound-muffling enclosure such that it cannot move relative to the sound-muffling enclosure, and a second mode in which the feet are resting against the support surface while the pump head/motor assembly is not locked to the sound-muffling enclosure and the sound-muffling enclosure is locked to the support surface independently of the feet, whereby the sound-muffling enclosure can be hard mounted to the support surface such that it cannot move relative to the support surface while the pump head/motor assembly is free mounted to the sound-muffling enclosure via the vibration isolation system such that it can vibrate relative to the sound-muffling enclosure.

2. The scroll pump as claimed in claim 1, wherein the feet are elastic members.

3. The scroll pump as claimed in claim 1, wherein the locking system comprises a set of first locking fasteners for selectively locking the pump head/motor assembly to the sound-muffling enclosure, and a set of brackets carried by the sound-muffling enclosure, each of the brackets including a horizontal leg having an opening extending vertically therethrough and through which a second fastener can be inserted to fasten the bracket to the support surface.

4. The scroll pump as claimed in claim 3, wherein the brackets are adjustable in the pump between a first position at which bottoms of the brackets are located above the level of the bottom surfaces of the feet in the pump and a second position at which the bottoms of the brackets are disposed level with the bottom surfaces of the feet.

5. The scroll pump as claimed in claim 4, wherein the sound-muffling enclosure comprises a tray, the feet support the tray at the bottom thereof, and the brackets are mounted to the tray so as to be movable relative to the tray between the first and second positions.

6. The scroll pump as claimed in claim 5, wherein the vibration isolation system comprises elastic vibration isolators each extending from the top of the tray to the pump head/motor assembly, and the pump head/motor assembly is disposed on and fixed to the vibration isolators at upper ends of the vibration isolators.

7. The scroll pump as claimed in claim 6, wherein the sound-muffling enclosure further comprises a cowling in which the pump head/motor assembly is housed, and wherein the cowling is mounted to the tray independently of the pump head/motor assembly such that the cowling is fixed to the vibration isolators at bottom ends thereof, and the pump head/motor assembly is movable in the pump by virtue of the elasticity of the vibration isolators so as to be movable relative to the cowling.

8. The scroll pump as claimed in claim 7, wherein the brackets also have vertical legs each with a slot elongated in the vertical direction extending therethrough, and the locking system further comprises third fasteners extending through the slots, respectively.

9. The scroll pump as claimed in claim 1, wherein the pump head/motor assembly has a set of threaded openings therein, and the locking system comprises brackets each including a horizontal leg having a hole extending vertically therethrough and through which a fastener can be inserted to fasten the bracket to the support surface, a vertical leg having a slot elongated in the vertical direction extending therethrough, and threaded fasteners extending freely through the slots in the vertical legs, respectively, and threaded to the sound-muffling enclosure, whereby the brackets can each be raised and lowered relative to the sound-muffling enclosure between a first position at which bottoms of the brackets are located above the level of the bottom surfaces of the feet in the pump and a second position at which the bottoms of the brackets are disposed level with the bottom surfaces of the feet, motion arresters integral with the sound-muffling enclosure, and set screws associated with the motion arresters, respectively, each of the set screws being threadingly engaged with the pump head/motor assembly within one of the set of the threaded openings therein, and each of the set screws being movable relative to the pump head/motor assembly between a first position at which the set screw is free of the motion arrester associated therewith and a second position at which the set screw is mated with the motion arrester associated therewith.

10. The scroll pump as claimed in claim 9, wherein each of the motion arresters has a recess therein, and each of the set screws associated therewith has a head, a shaft having a screw thread threadingly engaged with the pump head/motor assembly, and a stopper integral with the shaft, the stopper having a shape complementary to the recess in the motion arrester, and the stopper being received within the recess of the motion arrester as mated with the motion arrester when the set screw is in the second position thereof.

11. The scroll pump as claimed in claim 10, wherein the stopper is received in the recess as radially spaced from the motion arrester when the set screw is in the first position thereof such that the set screw allows but limits movement of the pump head/motor assembly relative to the sound-muffling enclosure via the vibration isolation system when the set screw is in the first position thereof.

12. A vibration management method for a scroll pump, the method comprising:

setting feet extending from the bottom of an enclosure of the pump, containing a pump head/motor assembly of the pump supported by a vibration isolation system, atop a support surface such that the pump head/motor assembly is supported by the support surface only via the vibration isolation system; and either subsequently locking the pump head/motor assembly to the support surface, independently of the vibration isolation system, with a locking system so that the pump can be transported along with the support surface in a first state in which the pump head/motor assembly is prevented from moving relative to the support surface, or subsequently fastening the enclosure independently of the feet to the support surface while operating the pump in a second state in which the pump head/motor assembly is supported by the support surface only via the vibration isolation system.

13. The method of claim 12, further comprising preventing the pump head/motor assembly from moving, relative to the support surface and while operating in the second state, beyond a predetermined range of motion with motion arresters that operate independently of the vibration isolation system.

* * * * *